US006157803A

United States Patent [19]

Agatsuma

[11] Patent Number: 6,157,803

[45] Date of Patent: Dec. 5, 2000

[54] DEVELOPING UNIT AND DEVELOPING ROLL CONTAINED THEREIN

[75] Inventor: Masahiro Agatsuma, Ebina, Japan

[73] Assignee: Fuji Xerox Co., Ltd., Tokyo, Japan

[21] Appl. No.: 09/417,022

[22] Filed: Oct. 12, 1999

[30] Foreign Application Priority Data

Nov. 6, 1998 [JP] Japan ..... 10-316269

[51] Int. Cl.[7] ..... G03G 15/09

[52] U.S. Cl. ..... 399/276

[58] Field of Search ..... 399/267, 286, 399/277, 222, 276

[56] References Cited

U.S. PATENT DOCUMENTS

| | | | |
|---|---|---|---|
| 4,018,187 | 4/1977 | Abbott et al. | 399/276 |
| 4,558,943 | 12/1985 | Patz | 399/276 X |
| 4,597,661 | 7/1986 | Yamashita | 399/276 |
| 4,615,606 | 10/1986 | Nishikawa | 399/276 X |
| 4,656,964 | 4/1987 | Kanno et al. | 399/267 |
| 4,982,689 | 1/1991 | Honda et al. | 399/276 X |
| 5,387,966 | 2/1995 | Karashima | 399/286 |
| 5,565,968 | 10/1996 | Sawa et al. | 399/286 |
| 5,608,502 | 3/1997 | Yamashita et al. | 399/276 |
| 5,729,805 | 3/1998 | Chiba et al. | 399/276 |
| 5,749,033 | 5/1998 | Swartz et al. | 399/267 |

FOREIGN PATENT DOCUMENTS

| | | |
|---|---|---|
| 61-250200 | 11/1986 | Japan . |
| 1-243084 | 9/1989 | Japan . |
| 2-132475 | 5/1990 | Japan . |

*Primary Examiner*—Susan S.Y. Lee
*Attorney, Agent, or Firm*—Oliff & Berridge PLC

[57] ABSTRACT

A developing unit has a developer housing and a developing roll contained therein, the developer housing holding a two-component developer composed of carrier and toner. The developing roll is placed facing the opening of the developer housing and provided with a magnet member and a developing sleeve. The magnet member has multiple magnetic poles fixed thereto, and the developing sleeve is rotatably slipped on the magnet member. The developing sleeve is formed from an aluminum substrate by roughening its surface and subsequently etching the roughened surface so that the resulting etched part has an average slope angle of 15 to 20°.

5 Claims, 13 Drawing Sheets

$$\Delta a = \frac{1}{L} \int_0^L \left| \frac{d}{dx} f(x) \right| dx, \quad \theta a = \tan^{-1} \Delta a$$

BEFORE ETCHING

AFTER ETCHING

FIG. 13

CHANGE IN SLEEVE ROUGHNESS (T = 0 → 500,000)

| | ALUMINUM SLEEVE | | | | | SUS SLEEVE |
|---|---|---|---|---|---|---|
| | ETCHING: NO | | ETCHING: YES | | | |
| | | | DURATION OF ETCHING: 6SEC | | : 12SEC | |
| | Rz10μm | Rz20μm | Rz10μm | Rz20μm | Rz20μm | Rz10μm |
| Rz (μm) | 11.80 → 10.40 | 24.18 → 19.46 | 11.14 → 9.98 | 20.53 → 18.70 | 17.72 → 17.40 | 11.51 → 11.40 |
| Ra (μm) | 1.52 → 1.36 | 3.44 → 2.87 | 1.58 → 1.37 | 2.56 → 2.38 | 2.41 → 2.40 | 1.24 → 1.26 |
| θa (deg) | 14.0 → 11.6 | 15.7 → 11.6 | 11.8 → 7.4 | 16.5 → 15.3 | 16.7 → 14.6 | 12.4 → 12.0 |

DEVELOPING UNIT AND DEVELOPING ROLL CONTAINED THEREIN

BACKGROUND OF THE INVENTION

1. Field of the invention

The present invention relates to a developing unit to develop an electrostatic latent image formed on a latent image carrier in the image-forming apparatus of electrophotography system or electrostatic recording system. More particularly, the present invention relates to an improvement in the developing unit (working with a two-component developer composed of carrier and toner) and a developing roll contained therein.

2. Description of the Related Art

The image-forming apparatus such as copying machines of electrophotography system or electrostatic recording system is customarily equipped with a developing unit to develop the electrostatic latent image formed on a latent image carrier (such as photosensitive drum).

The developing unit of this type operates differently depending on the kind of the developer employed. The developer of two-component type is the most commonest among those which are used for image-forming apparatus, particularly high-speed copying machines. This developer is usually composed of a carrier of iron powder and a resin-based toner. It is held in the developer housing with an opening for development. Opposite the opening is the developing roll, which is a magnet roll having multiple magnetic poles arranged and fixed thereon. The magnet roll is encased in a cylindrical non-magnetic developing sleeve turning around it.

The developing unit of this type mixes the developer (composed of a carrier and a toner) in the developer housing so as to charge the toner by friction. This charging causes the developer to form a magnetic brush of developer on the developing sleeve. The developing sleeve alone is turned so that the developer spreads over its peripheral surface. The developing sleeve carrying the developer is brought into contact with the latent image carrier on which is formed an electrostatic latent image. Thus the toner attaches itself to the electrostatic latent image to turn it into a visible toner image.

Common practice employed for the developing unit of this type is to have the surface of the developing sleeve minutely roughened so that the developer is carried easily. (This procedure is called surface roughening.)

The developing sleeve is made of aluminum or non-magnetic stainless steel. The surface roughening is accomplished mechanically (e.g., sand blasting by a high-velocity jet of hard particles of regular or irregular shape having a certain particle diameter) or electrochemically (e.g., electrolytic etching with pulsating current in an acid solution). See Japanese Patent Laid-open Nos. 250200/1986, 243084/1989, and 132475/1990.

Incidentally, improved image quality and long-life developer, which have been achieved recently, require the copying machines and printers to be more durable mechanically than before. Unfortunately, the developing unit of the type mentioned above has a limited life because its developing sleeve turns while holding the developer (composed of carrier and toner) during copying or printing. In the case of an aluminum developing sleeve, its surface is abraded by the carrier after continued operation. The result is that that the roughened surface of the developing sleeve becomes smooth with time. The developing sleeve with a smooth surface becomes poor in the ability to transport the developer, resulting in thin harsh images.

One way to solve this technical problem is to make the developing sleeve from durable stainless steel; however, this solution is unfavorable to cost saving and weight reduction.

One known way to improve the image quality is to use a toner composed of spherical particles. Such a toner, however, suffers the disadvantage of decreasing in friction with the developing sleeve or fluctuating in the amount of transport due to change in surface roughness with time.

OBJECT AND SUMMARY OF THE INVENTION

The present invention was completed in order to address the above-mentioned technical problems. It is an object of the present invention to provide a new developing unit and a new developing sleeve contained therein which are low in production cost, transport the developer stably even after continued operation, and produce good images without degradation with time.

The present invention covers a developing unit (as shown in FIG. 1) having a developer housing 1 and a developing roll 2 contained therein. The developer housing 1 has an opening 1*a* for developing and holds a two-component developer G composed of carrier and toner. The developing roll 2 is placed facing the opening 1*a* of the developer housing 1 and is provided with a magnet member 3 and a developing sleeve 4. The magnet member 3 has multiple magnetic poles fixed thereto. The developing sleeve 4 is rotatably slipped on the magnet member 3. The developing sleeve 4 is formed from an aluminum substrate 5 by roughening its surface and subsequently etching the roughened surface so that the resulting etched part 6 has an average slope angle (θa) of 15–20°.

The present invention also covers the developing sleeve 4 per se which is contained in the above-mentioned developing unit.

BRIEF DESCRIPTION OF THE DRAWINGS

FIG. 2(*b*) is a formula to mathematically define the average slope angle (θa).

FIG. 5(*b*) is a roughness curve showing the surface state of the developing sleeve which has undergone etching.

FIG. 13 is a table showing how the change with time in the surface roughness (in terms of Rz, Ra, and θa) varies depending on the kind of the developing sleeve.

DESCRIPTION OF THE PREFERRED EMBODIMENTS

According to the present invention, the sleeve substrate 5 should be made of aluminum and should have the etched part 6 which is formed by etching after surface roughening. Etching may be followed by optional post-treatment in anyway. But, such post-treatment is usually unnecessary.

Surface roughening may be accomplished by polishing with grindstone or sandpaper. However, sand blasting is desirable for accurate roughening.

Etching may be accomplished by either wet process or dry process. Wet process includes the dipping in an acid or alkaline solution and the anodic oxidation by electrolytic polishing. Dry process includes the exposure to a corrosive gas or the bombardment with ions in a vacuum chamber.

Figure 1:
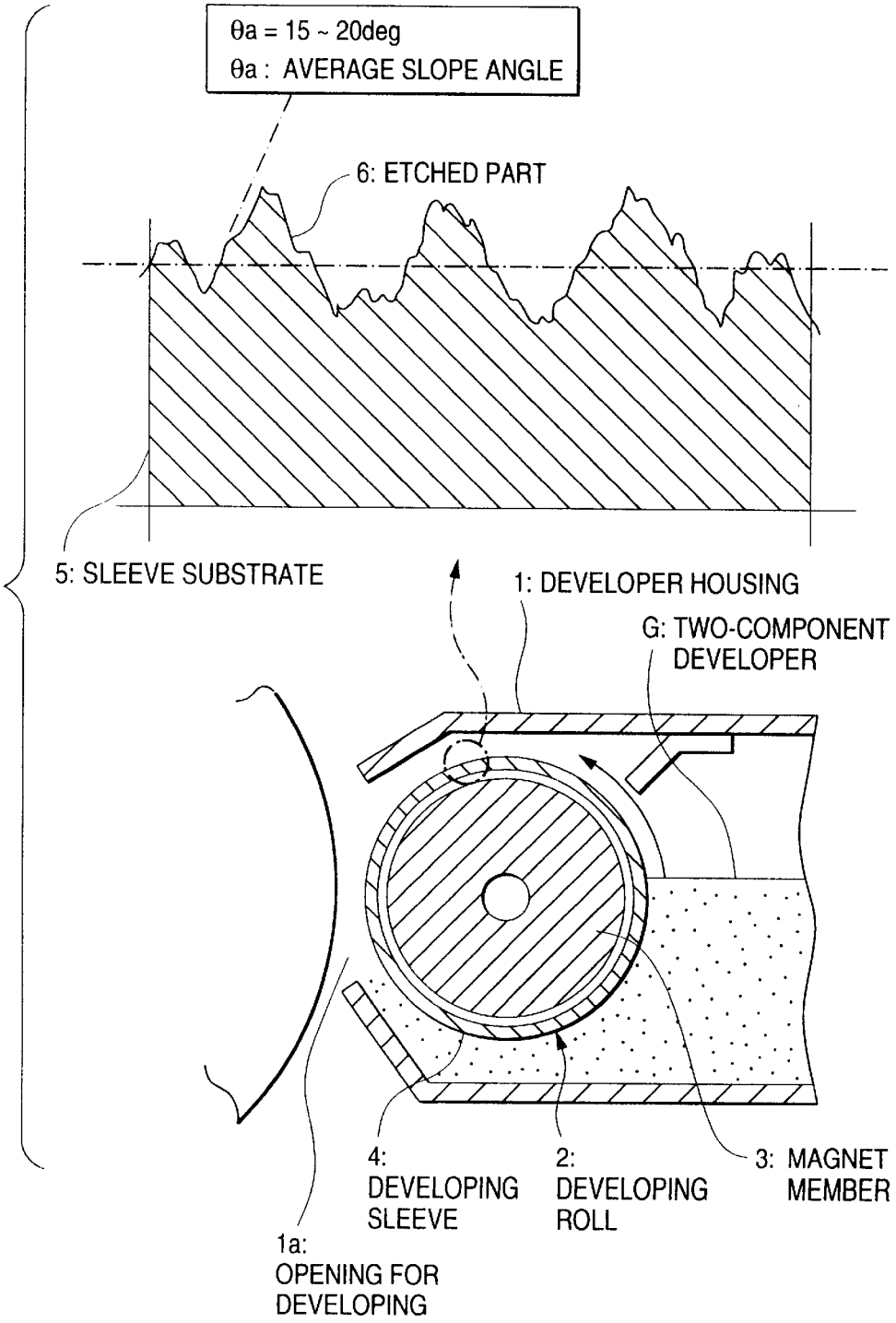
FIG. 1 is a schematic diagram showing the developing unit and the developing sleeve contained therein which are covered in the present invention.
Figure 2:
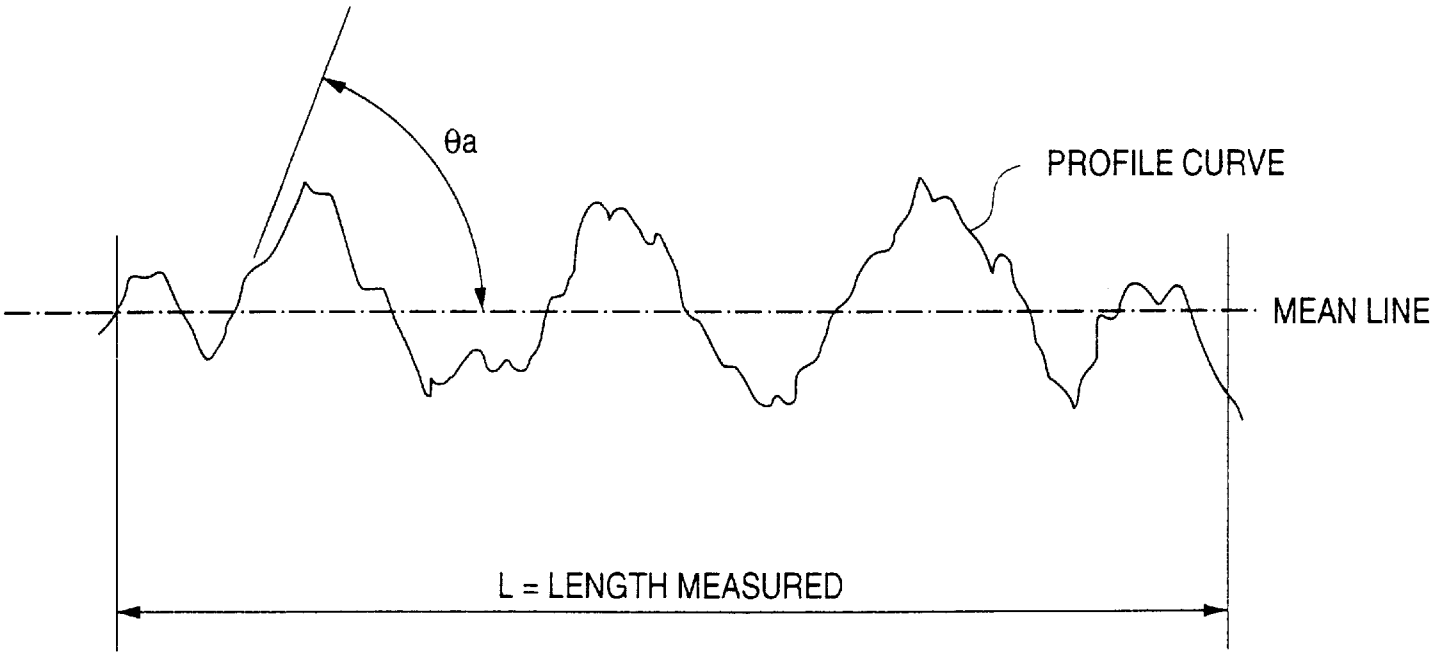
FIG. 2 (*a*) is a diagram to graphically define the average slope angle (θa).

The average slope angle (θa) in the present invention is defined as $\theta a = \tan^{-1}\Delta a$, where Δa is expressed by the equation below.

$$\Delta a = \frac{1}{L}\int_0^L \left|\frac{d}{dx} f(x)\right| dx$$

where f(x) represents an arbitrary sectional curve in the x direction and L represents a length measured, as shown in FIG. 2. The slope component (in absolute value) of the curve f(x) is integrated over the length L measured, and the resulting integral is divided by the length L.

The average slope angle θa is usually determined when the etched part 6 is produced.

Adequate values of the average slope angle θa range from 15° to 20°. With a value of θa smaller than 15°, the developing sleeve 4 causes fluctuation in the amount of the developer to be transported. With a value of θa greater than 20°, the developing sleeve 4 causes the toner to stick to its surface.

The toner of the two-component developer to be used in the developing unit is characterized by its shape factor, $S \leqq 140$.

The shape factor (S) is a numerical representation of the shape of toner particles. It is defined as follows.

$$S = \{ML^2 \cdot \pi/(4 \cdot A)\} \times 100$$

where ML is the maximum length of toner particles, and A is the projected area of toner particles.

Further, the toner of the two-component developer to be used in the developing unit may be produced in any manner. However, production by polymerization (such as emulsion polymerization) is desirable so that the shape of toner particles can be controlled as desired. The ordinary mixing and crushing process gives rise to toner particles which subtly vary in shape and surface structure depending on the raw material and the crushing conditions.

The technical features of the present invention are as follows.

The developing sleeve 4 is formed from an aluminum sleeve substrate 5.

The surface of the sleeve substrate 5 has an etched part 6 which is formed by surface roughening and ensuing etching on the roughened surface. Etching removes extremely fine irregularities produced by surface roughening, so that the resulting roughened surface is microscopically smooth.

The developing sleeve 4 does not change in its performance with time (because it does not have extremely fine irregularities which wear out with time).

The etched part 6 with an average slope angle (θa) within a specific range of 15° to 20° C. avoids fluctuation in the amount of the developer to be transported and prevents the toner from sticking to the surface of the developing sleeve 4.

The invention will be described in more detail with reference to the examples illustrated in the accompanying drawings.

Figure 3:
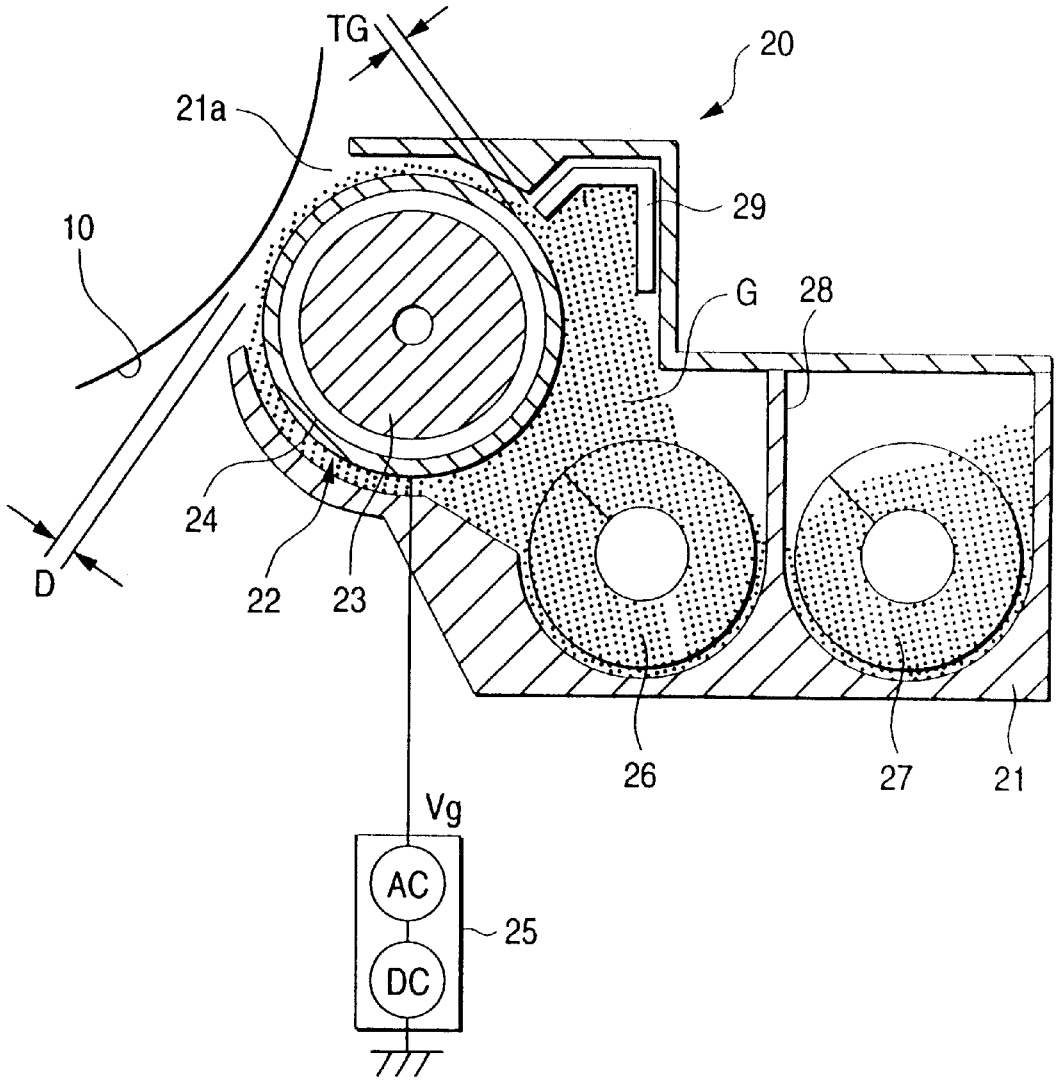
FIG. 3 is a schematic diagram illustrating one embodiment of the developing unit according to the present invention.

FIG. 3 is a schematic diagram showing the developing unit (for two-component developer) as one embodiment of the present invention. The developing unit 20 consists of a developer housing 21 and a developing roll 22. The developer housing 21 has an opening 21*a* facing the latent image carrier 10 (such as photoreceptor drum) and also holds therein a two-component developer G composed of carrier and toner. The developing roll 22 is installed such that it partly projects through the opening 21*a* of the developer housing 21.

The developing roll 22 consists of a magnet roll 23 (having multiple magnetic poles fixed thereto) and a non-magnetic developing sleeve 24 rotatably slipped thereon. There is a gap of about 300–400 μm between the developing sleeve 24 and the latent image carrier 10.

The developing sleeve 24 is connected to a bias source 25 to apply a developing bias Vg (which is an AC-superimposed DC bias).

Behind the developing roll 22 are arranged a pair of augers 26 and 27 (separated by a partition panel 28 integrally formed with the developer housing 21) which mix, circulate, and transport the developer G.

As the developer is transported onto the developing sleeve 24, its amount is controlled (to a desired layer thickness) by the trimmer 29. There is a trimming gap TG between the developing sleeve 24 and the trimmer 29, and it is adjusted for adequate development.

The developing unit as an embodiment of the present invention causes the augers 26 and 27 to transport the developer G to the developing roll 22 so that a magnetic brush of the developer is formed on the developing sleeve 24 by the magnetic force of the magnet roll 23. As the developing sleeve 24 turns, the developer passes through the trimmer 29 and becomes a thin layer with a thickness corresponding to the trimming gap TG. Thus the developer is transported (at a rate of 300 to 400 g/m$^2$) to the developing region 10 facing the latent image carrier 10.

Since the developing sleeve 24 is biased by Vg, the layer of the developer on the developing sleeve 24 makes visible the electrostatic latent image on the latent image carrier 10.

The toner of the two-component developer used in this embodiment is one which is produced by polymerization. It has an average particle diameter of 5 to 6 μm (volume mean diameter) and a shape factor (S) of 120 to 130. The shape factor (S) is defined as above. The carrier used in this embodiment is one which has an average particle diameter of 30 to 40 μm and a resistance of $10^{10}$ to $10^{13}$ Ω·cm. These values are not intended to restrict the scope of the invention.

Figure 4:
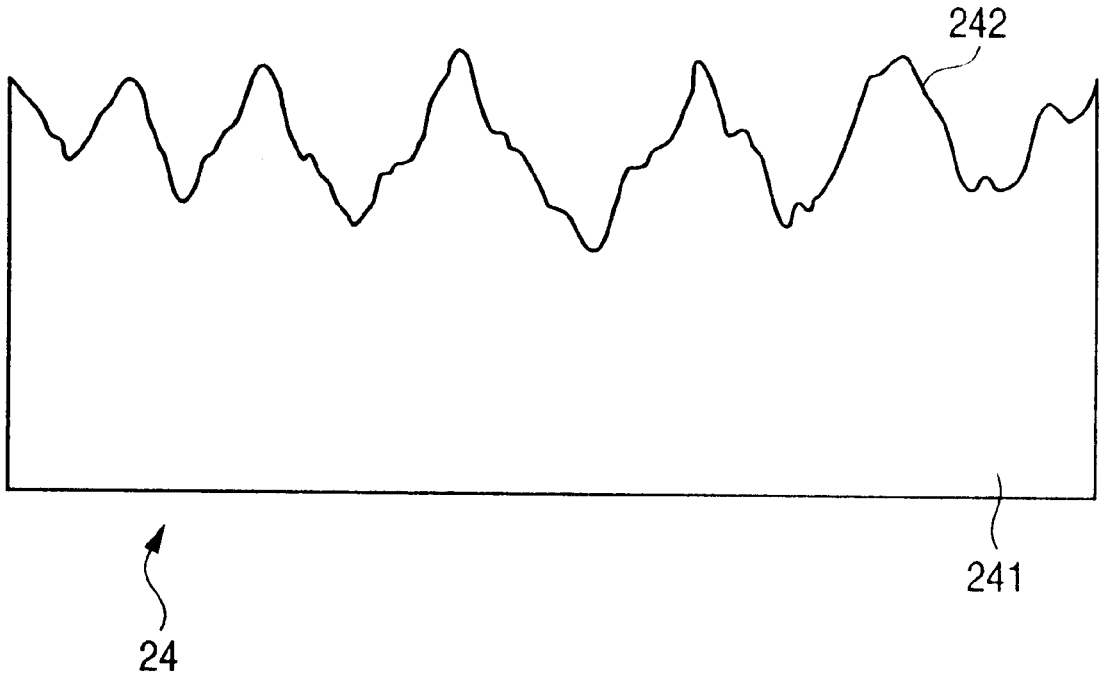
FIG. 4 is a schematic diagram showing the surface state of the developing sleeve used in the embodiment of the present invention.

As shown in FIG. 4, the developing sleeve 24 used in this embodiment has on its aluminum sleeve substrate 241 an irregular surface 242 formed by surface roughening and ensuing etching in the following manner.

A cylindrical aluminum sleeve substrate 21 undergoes sandblasting such that its surface has a prescribed value of Rz (ten-point height of irregularities), say about 20 μm. Then the sleeve substrate is dipped for etching in an aqueous solution of sodium hydroxide (3 to 5%) for a prescribed length of time, say 12 seconds. This alkaline etchant maybe replaced by an acid etchant.

Figure 5:
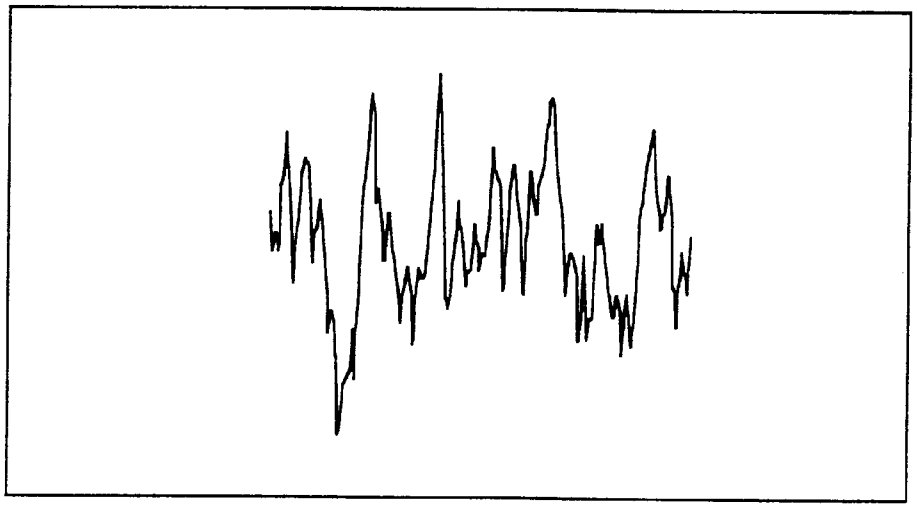
FIG. 5(*a*) is a roughness curve showing the surface state of the developing sleeve which does not yet undergo etching.
Figure 5:
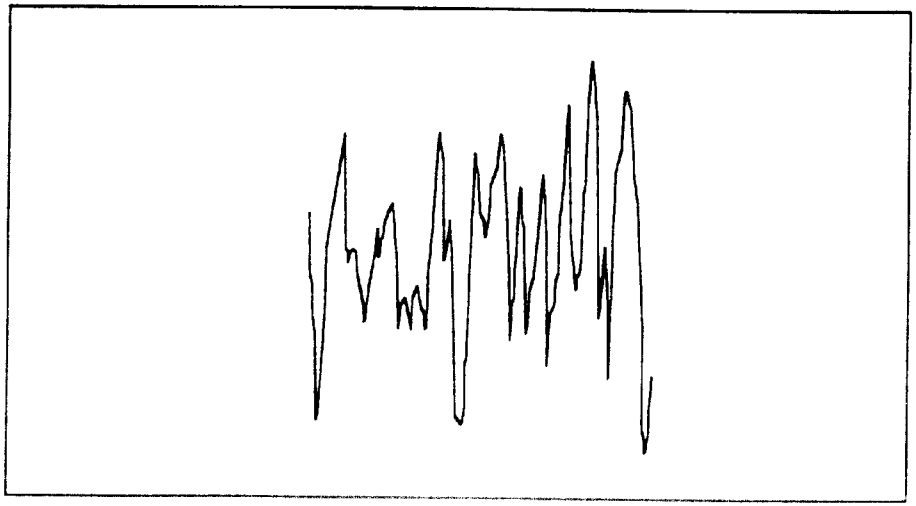
Figure 6:
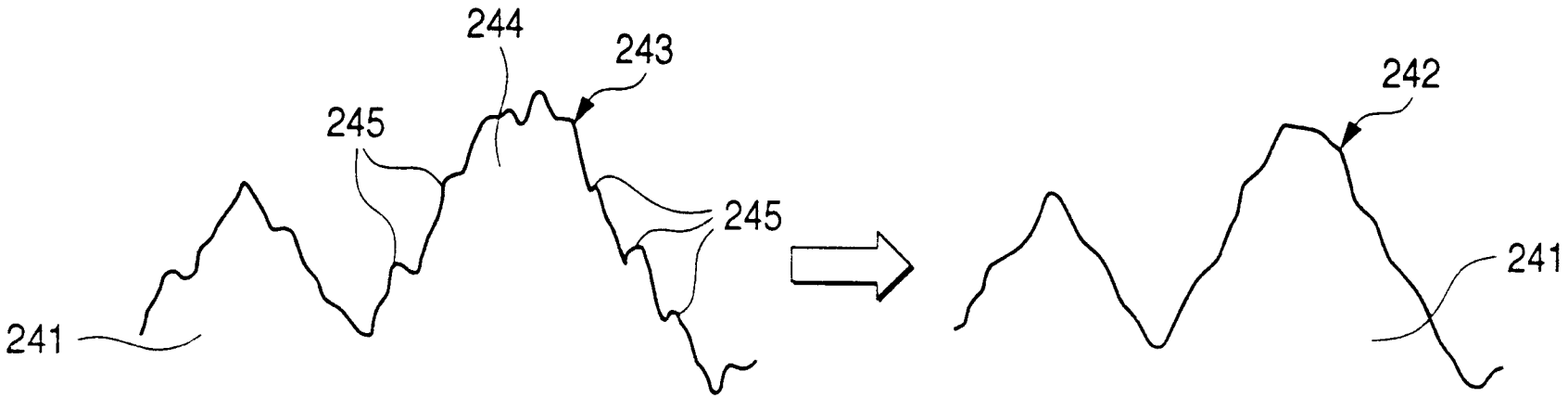
FIG. 6 is an enlarged diagram showing the profile of surface irregularities which changes after etching.

The sleeve substrate was examined for surface irregularities after sandblasting and after etching by using a microprofile meter (from Tokyo Seimitsu Co., Ltd.). The results are shown in FIGS. 5(*a*) and 5(*b*). It is noted that the roughness curve has fine irregularities after sand blasting and these fine irregularities disappear after etching. FIG. 6 shows a profile of the roughened surface 243 of the sleeve substrate 241. After sand blasting (or before etching), the irregularities 244 formed by sand blasting have extremely small irregularities 245. After etching, the extremely small irregularities 245 are removed by etching and hence the roughened surface of the sleeve substrate 241 has a smooth profile.

Figure 7:
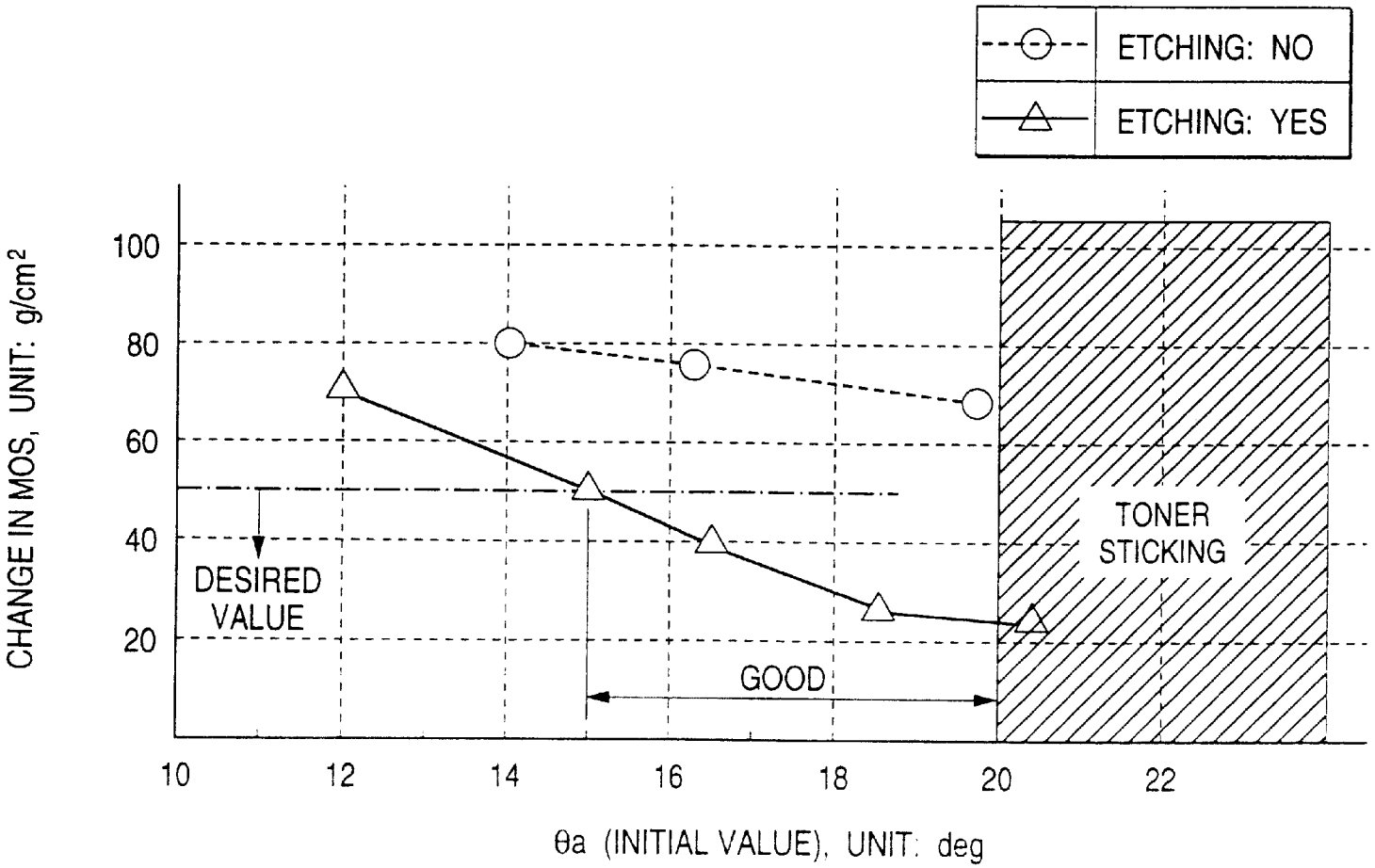
FIG. 7 is a graph showing the relation between the initial average slope angle (θa) and the change with time in the amount of the developer transported (in terms of MOS=mass on the sleeve).

In this embodiment, several developing sleeves differing in average slope angle (θa) were prepared, and they were evaluated by actual copying operation. The result of evaluation is expressed by comparing the amount of the developer transported initially by the new developing sleeve with the amount of the developer transported by the developing sleeve after 500,000 runs of copying operation. Incidentally, the average slope angle (θa) is defined as above. The results are shown in FIG. 7. The samples are regarded as satisfactory if the amount of the developer transported changes less than 50 g/m$^2$ after copying operation. This desired value is established in consideration of density decrease and image degradation.

It is noted from FIG. 7 that the samples without etching exceed the desired value regardless of the average slope angle (θa). It is noted that the samples with etching also exceed the desired value if they have an average slope angle (θa) smaller than 15°. It is noted that the samples with etching cause the toner to stick to their surface if they have an average slope angle (θa) greater than 20°. (Sticking is a problem in practical operation.)

It follows from the foregoing that the average slope angle (θa) should be in the range of $15 \leqq \theta a \leqq 20$ (degrees).

A sample of developing sleeve with an average slope angle (θa) of 16.5° was prepared. Another sample of developing sleeve was prepared which had not undergone etching. They were run 500,000 times for copying operation. Relations between the shape factor (S) of the toner and the change in the amount of the developer transported were investigated. The results are shown in FIG. 8.

Figure 8:
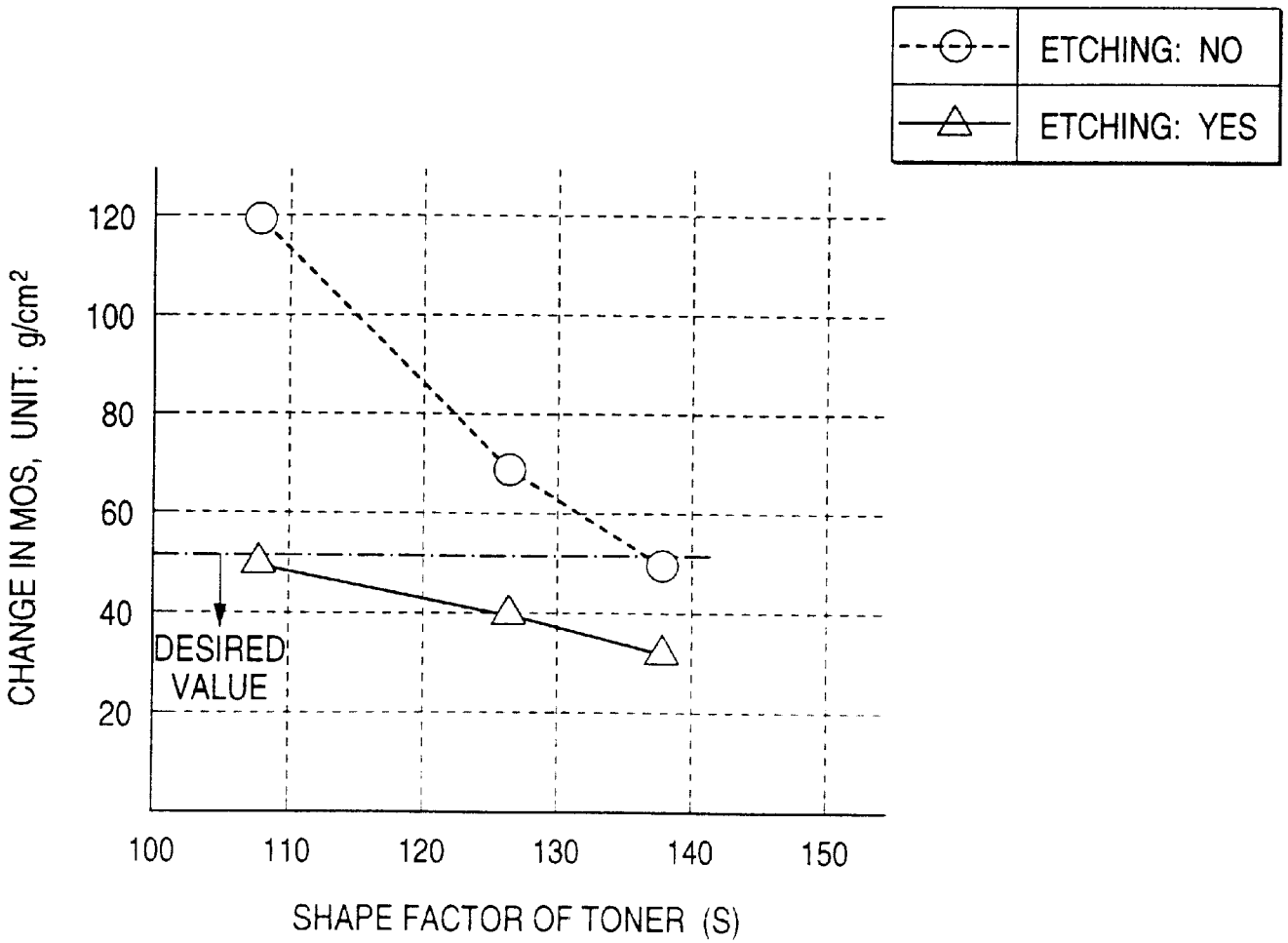
FIG. 8 is a graph showing the relation between the shape factor of the toner and the change with time in the amount of the developer transported (in terms of MOS).

It is noted from FIG. 8 that the developer changes only a little in the amount transported regardless of etching if the toner has a large shape factor (S) (meaning that the toner has an irregular shape produced by the conventional crushing technology). It is also noted that the developer greatly changes in the amount transported in the case of the developing sleeve without etching according as the toner increases in shape factor (becoming more spherical). This suggests the necessity of etching.

Samples of developing sleeves with or without etching were prepared. They were run 500,000 times for copying operation. After copying operation, they were examined for change in the average slope angle (θa). The results are shown in FIG. 9.

Figure 9:
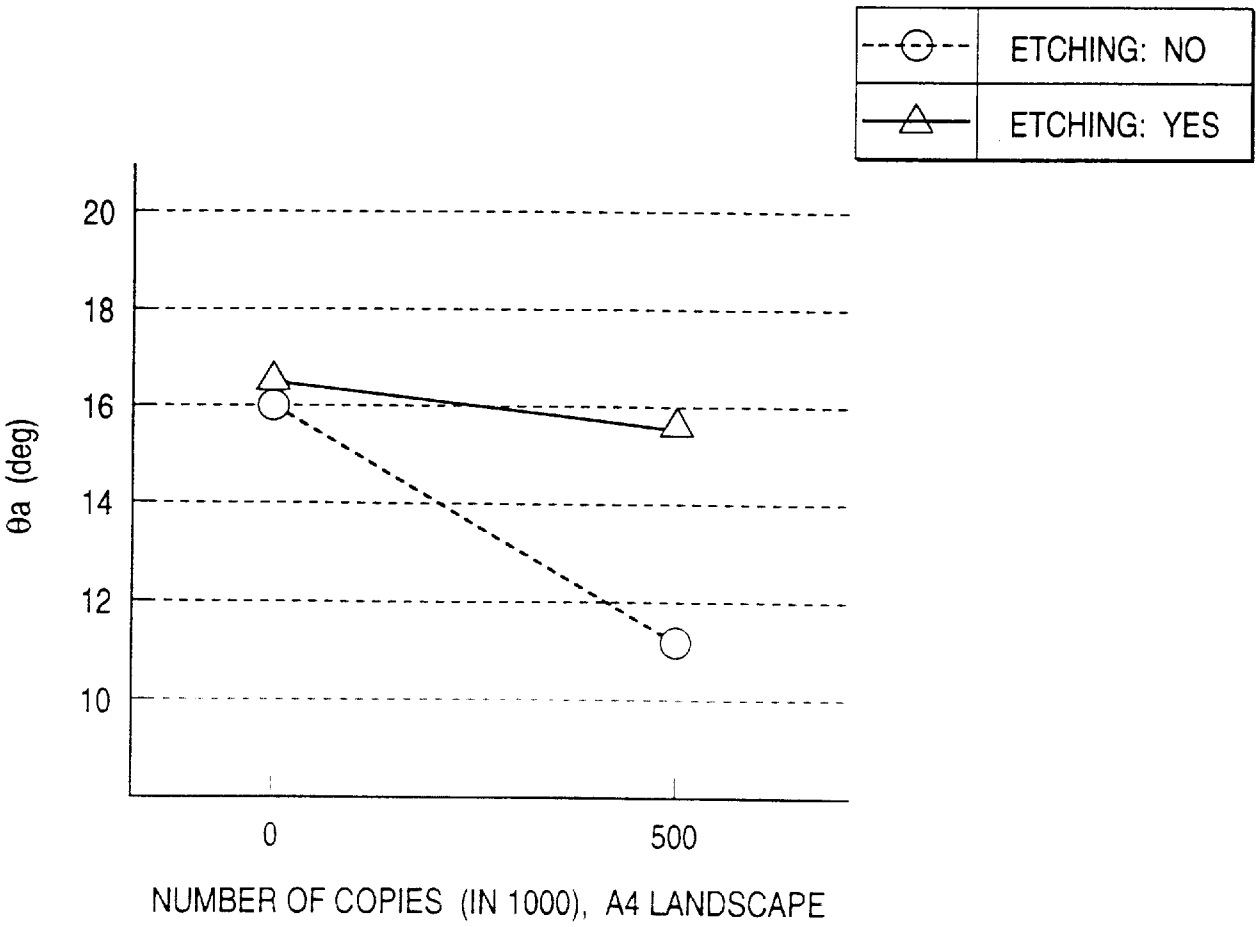
FIG. 9 is a graph showing how the change with time in the average slope angle (θa) is affected by whether or not the roughened surface of the developing sleeve undergoes etching.

It is noted from FIG. 9 that the developing sleeve with etching changes little with time in the average slope angle (θa). This means that the developing sleeve with etching (as in this embodiment) transfers the developer constantly.

It is understood from the foregoing that the developing sleeve 24 will transport the developer constantly if the aluminum sleeve substrate 241 undergoes surface roughening and ensuing etching (which forms the etched part 242) and the etched part 242 has an average slope angle (θa) of 15°to 20°.

The developing unit in the above-mentioned embodiment was evaluated in the following example.

Example

A developing sleeve was prepared from an aluminum sleeve substrate, with its surface roughened by sand blasting (without etching). The roughened surface has an Rz (ten-point height of irregularities) of 10 μm. A developing unit equipped with this developing sleeve was run with five kinds of toners (I to V) differing in the shape factor S. (Toner III having the greatest shape factor is one which was prepared by crushing.) With the toner concentration (TC) kept at 5%, the developing unit was tested for variation in MOS (mass on the sleeve) per 0.1 mm of trimming gap (TG). The results are shown in FIG. 10.

Figure 10:
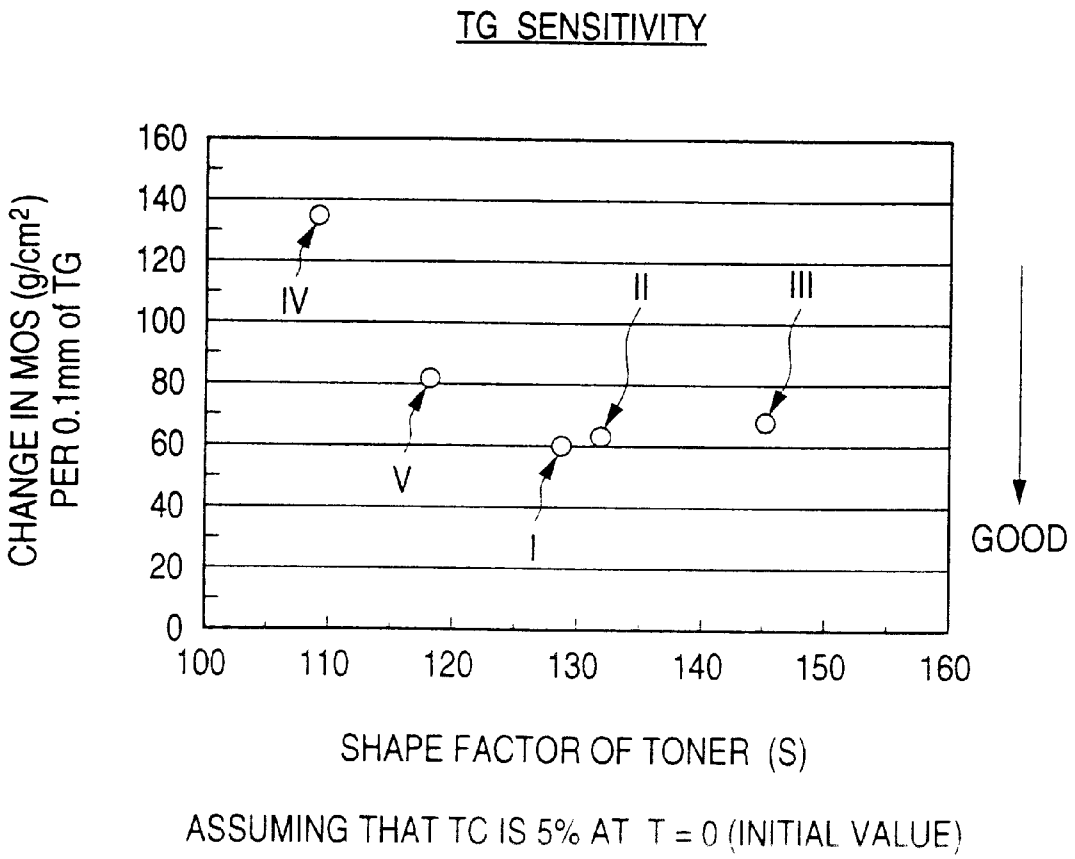
FIG. 10 is a graph showing the relation between the shape factor of the toner and the variation in MOS (mass on the sleeve) per 0.1 mm of trimming gap (TG).

It is noted from FIG. 10 that the MOS variation (TG sensitivity) per 0.1 mm of trimming gap (TG) decreases according as the shape factor (S) increases.

The same developing unit as mentioned above was run with three kinds of toners (I to III) differing in the shape factor (S). With the toner concentration (TC) changed over a range of 2 to 8%, the developing unit was tested for variation in MOS with time (after 500,000 runs). The results are shown in FIG. 11.

Figure 11:
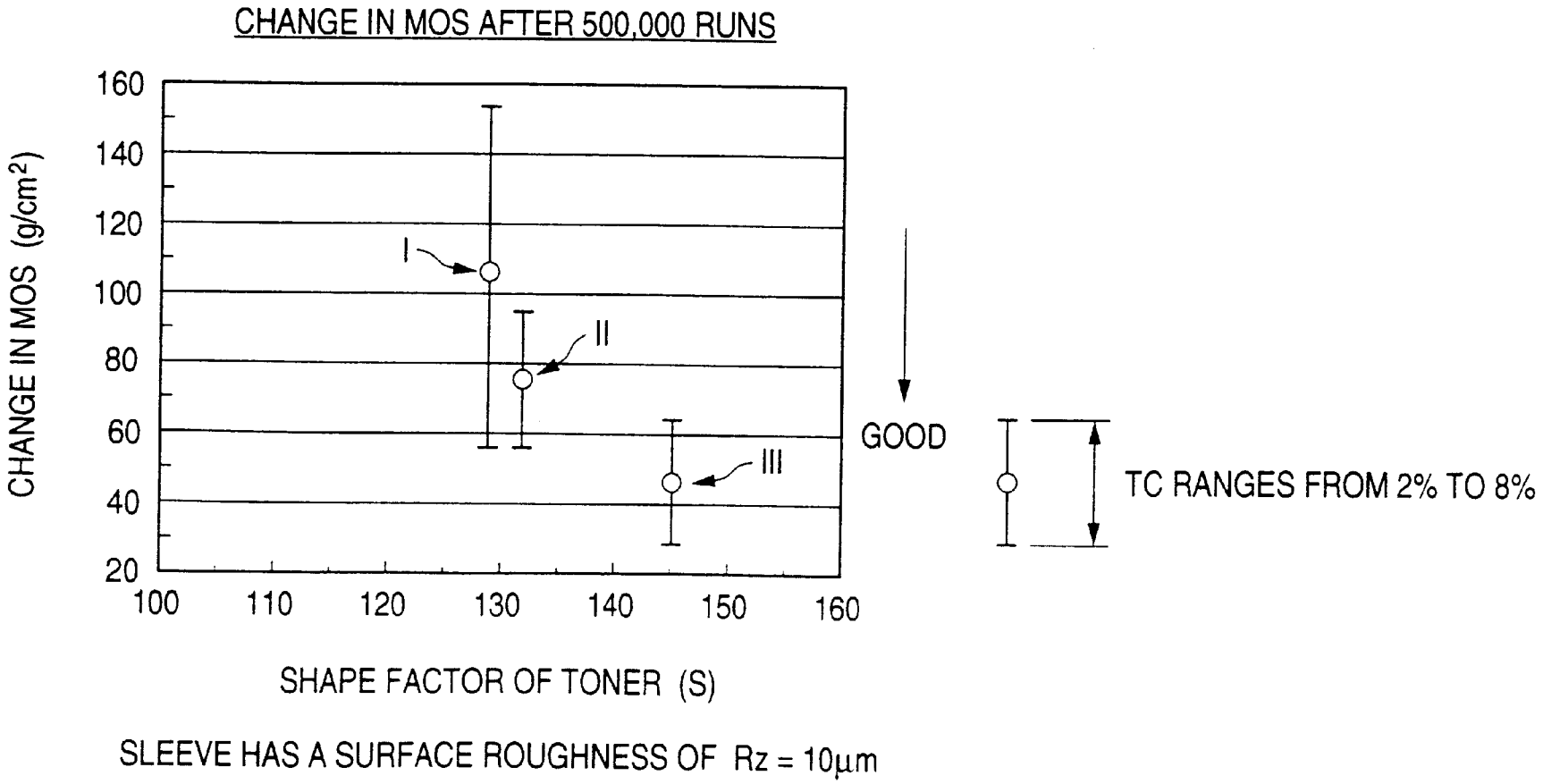
FIG. 11 is a graph showing the relation between the shape factor of the toner and the change with time in MOS (after 500,000 runs).

It is noted from FIG. 11 that the variation of MOS for the same range of toner concentration decreases according as the shape factor (S) decreases.

Figure 12:
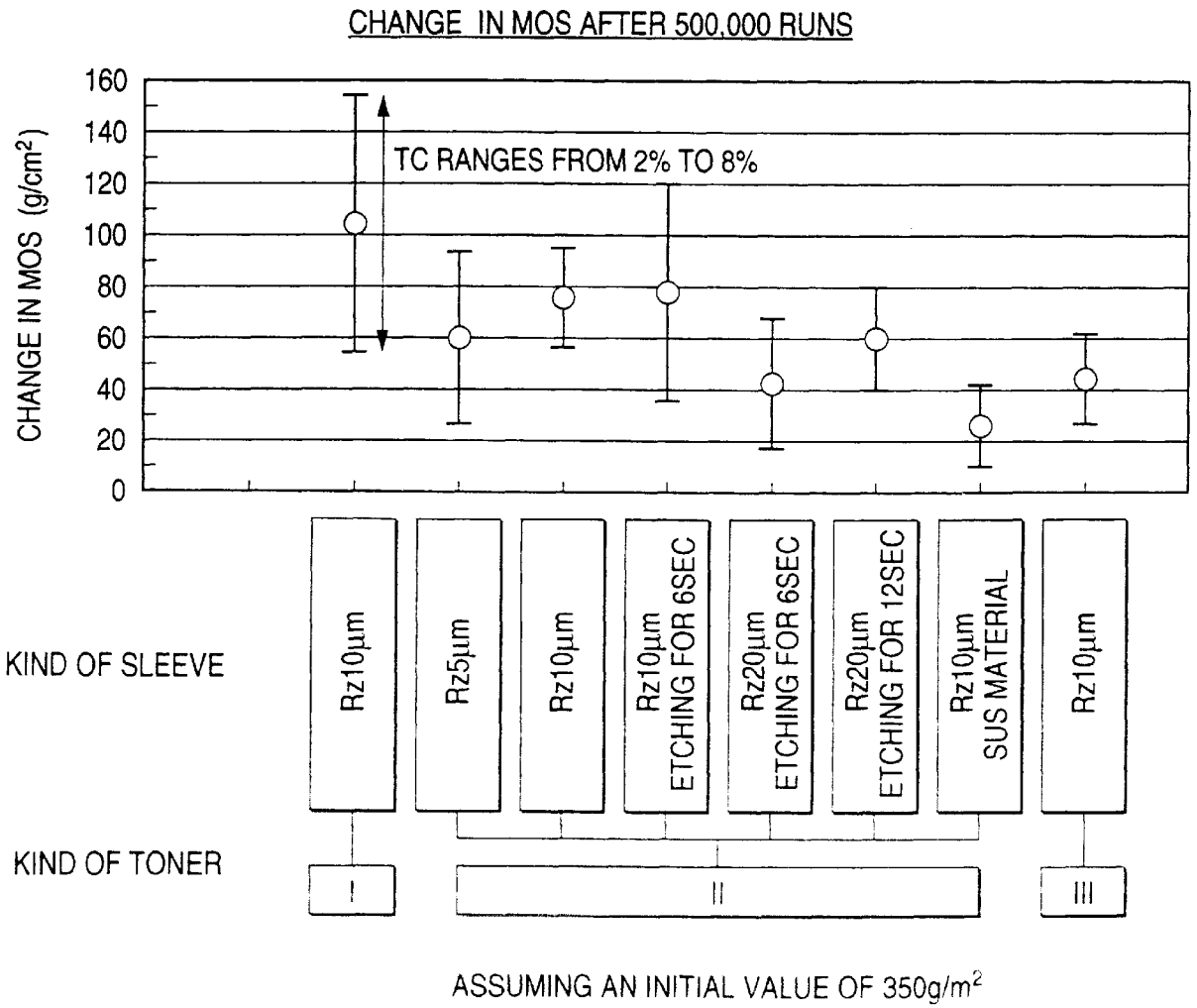
FIG. 12 is a diagram showing how the change with time in MOS (after 500,000 runs) varies depending on the kind of the sleeve and the kind of the toner.

Several kinds of developing sleeves with or without etching were prepared which differ in the value of Rz and the material of the sleeve substrate. The same developing unit as mentioned above was equipped with one of these developing sleeves. It was run with three kinds of toners (I to III) differing in the shape factor (S). With the toner concentration (TC) changed over a range of 2 to 8%, the developing unit was tested for variation in MOS with time (after 500,000 runs). The results are shown in FIG. 12. An initial value of 350 g/m$^2$ is assumed for the amount of the developer transported. Each vertical line indicates the range of toner concentration from 2% to 8%.

It is noted from FIG. 12 that the variation in MOS with time (after 500,000 runs) is greater in the case of polymerized toner II than in the case of crushed toner III. However, this is not necessarily true if the developing sleeve has an etched surface whose Rz is 20 μm.

Results similar to those in this example were obtained even when the developing sleeve with an Rz of 20 μm was replaced by an etched one with an Rz of 15 μm. However, results were rather poor in the case of an etched developing sleeve with an Rz of 10 μm. It is concluded from the foregoing that the developing sleeve should have an Rz value greater than 15 μm.

Various kinds of developing sleeves were prepared which differ in ten-point height of irregularities (Rz), center line average height (Ra), and average slope angle (θa). They were tested for change with time (up to 500,000 runs) in surface roughness. The results are shown in FIG. 13.

It is noted from FIG. 13 that the average slope angle (θa) decreases with time from 15.7°to 11.6°in the case of the developing sleeve which has an Rz value of 20 μm (without etching) and hence greatly varies in MOS after 500,000 runs.

By contrast, it is also noted that the average slope angle (θa) decreases with time from 16.5° to 15.3° or from 16.7° to 14.6° in the case of the developing sleeve which has an Rz value of 20 μm (with etching for 6 sec or 12 sec) and hence only slightly varies in MOS after 500,000 runs. In this case, the initial value is larger than 15° and the decrease is not so great as mentioned above.

It is also noted that the average slope angle (θa) decreases with time from 11.9° to 7.4° in the case of the developing sleeve which has an Rz value as small as 10 μm (with etching). In this case, the initial value of the average slope angle (θa) is smaller than 15°.

It is concluded from the foregoing that the object of minimizing the variation of MOS after 500,000 runs is achieved by performing surface roughening and ensuing etching on the aluminum developing sleeve so that it has an average slope angle (θa) greater than 15°.

[Effect of the invention]

As mentioned above, the present invention provides a developing sleeve which is formed by performing surface roughening and ensuing etching on the surface of an aluminum sleeve substrate. The etching produces the etched part whose average slope angle is 15° to 20°. Consequently, the developing sleeve transports the developer almost constantly while preventing the toner from sticking to it. Therefore, the present invention obviates the necessity of expensive developing sleeves of stainless steel. The developing sleeve of the present invention keeps producing images of high quality with a minimum of degradation over a long run. In addition, the developing sleeve of the present invention can handle a large variety of toners.

What is claimed is:

1. A developing unit comprising:

a developer housing having an opening for developing, and holding two-component developer composed of carrier and toner; and a developing roll placed facing the opening of the developer housing, the developing roll being provided with a magnet member having a plurality of magnetic poles fixed thereto, and a developing sleeve rotatably disposed around the magnet member, the developing sleeve being formed from an aluminum substrate by roughening a surface thereof and subsequently etching the roughened surface so that the etched part has an average slope angle from 15° to 20°.

2. A developing roll comprising:

a magnetic member having a plurality of magnetic poles fixed thereto; and a developing sleeve being rotatably disposed around the magnetic member, the developing sleeve being formed from an aluminum substrate by roughening a surface thereof and subsequently etching the roughened surface so that the etched part has an average slope angle from 15° to 20°.

3. The developing roll as defined in claim 2, wherein the developing sleeve undergoes etching as the final step of the process of forming thereof.

4. The developing unit as defined in claim 1, wherein the toner of the two-component developer has a shape factor $S \leqq 140$, with S being defined as follows.

$$S=\{ML^2 \cdot \pi/(4 \cdot A)\} \times 100$$

where ML is the maximum length of toner particles, and A is the projected area of toner particles.

5. The developing unit as defined in claim 1, wherein the toner of the two-component developer is produced by polymerization.

* * * * *